US007618115B2

(12) United States Patent
Chigusa

(10) Patent No.: US 7,618,115 B2
(45) Date of Patent: Nov. 17, 2009

(54) IMAGE FORMING APPARATUS

(75) Inventor: Yoshinari Chigusa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 408 days.

(21) Appl. No.: 11/630,521

(22) PCT Filed: May 22, 2006

(86) PCT No.: PCT/JP2006/010596

§ 371 (c)(1),
(2), (4) Date: Dec. 20, 2006

(87) PCT Pub. No.: WO2006/132099

PCT Pub. Date: Dec. 14, 2006

(65) Prior Publication Data

US 2007/0263022 A1 Nov. 15, 2007

(30) Foreign Application Priority Data

Jun. 6, 2005 (JP) ..... 2005-165965

(51) Int. Cl.
*B41J 29/393* (2006.01)
*B41J 29/38* (2006.01)

(52) U.S. Cl. ..... 347/19; 347/14

(58) Field of Classification Search ..... 347/14, 347/19, 68, 70–72
See application file for complete search history.

(56) References Cited

U.S. PATENT DOCUMENTS 6,584,291 B1 6/2003 Yamamoto

FOREIGN PATENT DOCUMENTS

| | | |
|---|---|---|
| JP | 9-11490 | 1/1997 |
| JP | 9-187963 | 7/1997 |
| JP | 10-175312 | 6/1998 |
| JP | 2001-83842 | 3/2001 |
| JP | 2001-260386 | 9/2001 |
| JP | 2002-370382 | 12/2002 |
| JP | 2003-107970 | 4/2003 |
| JP | 2005-22146 | 1/2005 |

*Primary Examiner*—An H Do
(74) *Attorney, Agent, or Firm*—Cooper & Dunham, LLP

(57) ABSTRACT

An image forming apparatus includes a unit to calculate the number of pages printable with remaining color material based on statistical data on the amount of consumed color material and the number of printed pages and report the calculated number of pages printable with remaining color material.

15 Claims, 11 Drawing Sheets

FIG.6A

| | | BLACK | | | | | | | | |
|---|---|---|---|---|---|---|---|---|---|---|
| | | CONSUMED AMOUNT PER PAGE | | | | | | NUMBER OF PRINTABLE PAGES | | |
| USER IDENTIFIER | NUMBER OF PRINTED PAGES | AMOUNT OF CONSUMED COLOR MATERIAL PER PAGE A | AMOUNT OF CONSUMED COLOR MATERIAL SQUARED AND DIVIDED BY NO. PAGES B | STANDARD DEVIATION OF AMOUNT OF CONSUMED COLOR MATERIAL PER PAGE C = SQRT(B-A*A) | MINIMUM AMOUNT OF CONSUMED COLOR MATERIAL PER PAGE D = A-C | MAXIMUM AMOUNT OF CONSUMED COLOR MATERIAL PER PAGE E = A+C | REMAINING COLOR MATERIAL AMOUNT F | AVERAGE G = F/A | MAXIMUM H = F/D | MINIMUM I = F/E |
| TOTAL | 180 | 8.444 | 72.237 | 0.964 | 7.481 | 9.408 | 500.000 | 59.211 | 66.837 | 53.146 |
| HANAKO | 100 | 8.000 | 64.667 | 0.816 | 7.184 | 8.816 | 500.000 | 62.500 | 69.604 | 56.712 |
| TARO | 80 | 9.000 | 81.700 | 0.837 | 8.163 | 9.837 | 500.000 | 55.556 | 61.249 | 50.830 |

FIG.6B

| | | CYAN | | | | | | | | |
|---|---|---|---|---|---|---|---|---|---|---|
| | | CONSUMED AMOUNT PER PAGE | | | | | | NUMBER OF PRINTABLE PAGES | | |
| USER IDENTIFIER | NUMBER OF PRINTED PAGES | AMOUNT OF CONSUMED COLOR MATERIAL PER PAGE A | AMOUNT OF CONSUMED COLOR MATERIAL SQUARED AND DIVIDED BY NO. PAGES B | STANDARD DEVIATION OF AMOUNT OF CONSUMED COLOR MATERIAL PER PAGE C = SQRT(B-A*A) | MINIMUM AMOUNT OF CONSUMED COLOR MATERIAL PER PAGE D = A-C | MAXIMUM AMOUNT OF CONSUMED COLOR MATERIAL PER PAGE E = A+C | REMAINING COLOR MATERIAL AMOUNT F | AVERAGE G = F/A | MAXIMUM H = F/D | MINIMUM I = F/E |
| TOTAL | 180 | 8.556 | 74.130 | 0.964 | 7.481 | 9.408 | 500.000 | 59.211 | 66.837 | 53.146 |
| HANAKO | 100 | 9.000 | 81.700 | 0.837 | 8.163 | 9.837 | 500.000 | 55.556 | 61.249 | 50.830 |
| TARO | 80 | 8.000 | 64.667 | 0.816 | 7.184 | 8.816 | 500.000 | 62.500 | 69.604 | 56.712 |

FIG.7A

| | | MAGENTA | | | | | | | | |
|---|---|---|---|---|---|---|---|---|---|---|
| | | CONSUMED AMOUNT PER PAGE | | | | | | NUMBER OF PRINTABLE PAGES | | |
| USER IDENTIFIER | NUMBER OF PRINTED PAGES | AMOUNT OF CONSUMED COLOR MATERIAL PER PAGE A | AMOUNT OF CONSUMED COLOR MATERIAL SQUARED AND DIVIDED BY NO. PAGES B | STANDARD DEVIATION OF AMOUNT OF CONSUMED COLOR MATERIAL PER PAGE C = SQRT(B-A*A) | MINIMUM AMOUNT OF CONSUMED COLOR MATERIAL PER PAGE D = A-C | MAXIMUM AMOUNT OF CONSUMED COLOR MATERIAL PER PAGE E = A+C | REMAINING COLOR MATERIAL AMOUNT F | AVERAGE G = F/A | MAXIMUM H = F/D | MINIMUM I = F/E |
| TOTAL | 180 | 8.667 | 78.002 | 1.700 | 6.966 | 10.367 | 500.000 | 57.692 | 71.773 | 48.230 |
| HANAKO | 100 | 10.000 | 100.670 | 0.819 | 9.181 | 10.819 | 500.000 | 50.000 | 54.458 | 46.217 |
| TARO | 80 | 7.000 | 49.667 | 0.816 | 6.184 | 7.816 | 500.000 | 71.429 | 80.860 | 63.967 |

FIG.7B

| | | YELLOW | | | | | | | | |
|---|---|---|---|---|---|---|---|---|---|---|
| | | CONSUMED AMOUNT PER PAGE | | | | | | NUMBER OF PRINTABLE PAGES | | |
| USER IDENTIFIER | NUMBER OF PRINTED PAGES | AMOUNT OF CONSUMED COLOR MATERIAL PER PAGE A | AMOUNT OF CONSUMED COLOR MATERIAL SQUARED AND DIVIDED BY NO. PAGES B | STANDARD DEVIATION OF AMOUNT OF CONSUMED COLOR MATERIAL PER PAGE C = SQRT(B-A*A) | MINIMUM AMOUNT OF CONSUMED COLOR MATERIAL PER PAGE D = A-C | MAXIMUM AMOUNT OF CONSUMED COLOR MATERIAL PER PAGE E = A+C | REMAINING COLOR MATERIAL AMOUNT F | AVERAGE G = F/A | MAXIMUM H = F/D | MINIMUM I = F/E |
| TOTAL | 180 | 6.111 | 39.000 | 1.286 | 4.825 | 7.397 | 500.000 | 81.818 | 103.629 | 67.592 |
| HANAKO | 100 | 7.000 | 49.667 | 0.816 | 6.184 | 7.816 | 500.000 | 71.429 | 80.860 | 63.967 |
| TARO | 80 | 5.000 | 25.667 | 0.816 | 4.184 | 5.816 | 500.000 | 100.000 | 119.517 | 85.962 |

FIG.8A

| | NUMBER OF PRINTED PAGES | AMOUNT OF CONSUMED COLOR MATERIAL |
|---|---|---|
| ADDITIONAL PRINTING | N | P |

FIG.8B

| | NUMBER OF PRINTED PAGES | AMOUNT OF CONSUMED COLOR MATERIAL PER PAGE A | AMOUNT OF CONSUMED COLOR MATERIAL SQUARED AND DIVIDED BY NO. PAGES B |
|---|---|---|---|
| OLD VALUES | M | Am | Bm |
| NEW VALUES | M+N | (M*Am+P)/(M+N) | (M*Am+P*P/N)/(M+N) |

FIG.9A

| | NUMBER OF PRINTED PAGES | AMOUNT OF CONSUMED COLOR MATERIAL |
|---|---|---|
| ADDITIONAL PRINTING | 8 | 45 |

FIG.9B

| | CONSUMED AMOUNT PER PAGE | | | | | | NUMBER OF PRINTABLE PAGES | | |
|---|---|---|---|---|---|---|---|---|---|
| NUMBER OF PRINTED PAGES | AMOUNT OF CONSUMED COLOR MATERIAL PER PAGE A | AMOUNT OF CONSUMED COLOR MATERIAL SQUARED AND DIVIDED BY NO. PAGES B | STANDARD DEVIATION OF AMOUNT OF CONSUMED COLOR MATERIAL PER PAGE C = SQRT(B-A*A) | MINIMUM AMOUNT OF CONSUMED COLOR MATERIAL PER PAGE D = A-C | MAXIMUM AMOUNT OF CONSUMED COLOR MATERIAL PER PAGE E = A+C | REMAINING COLOR MATERIAL AMOUNT F | AVERAGE G = F/A | MAXIMUM H = F/D | MINIMUM I = F/E |
| 80 | 5.000 | 25.667 | 0.816 | 4.184 | 5.816 | 500.000 | 100.000 | 119.517 | 85.962 |
| 88 | 5.057 | 26.210 | 0.799 | 4.258 | 5.856 | 500.000 | 98.876 | 117.430 | 85.386 |

IMAGE FORMING APPARATUS

TECHNICAL FIELD

The present invention generally relates to an image forming apparatus, and more particularly relates to an image forming apparatus which can calculate and report the number of printable pages based on the amount of remaining color material.

BACKGROUND ART

One example of an image forming apparatus is an inkjet recording apparatus. An inkjet recording apparatus records information (prints characters, prints photographs, forms images, and so on) by spraying ink from recording heads onto a medium (hereafter called a paper sheet, which is not limited to a sheet of paper but also includes an OHP sheet, a recording medium, recording paper, and the like).

In general, such an image forming apparatus is equipped with replaceable ink-containing units called ink cartridges or ink tanks for supplying ink to the recording heads, and is configured to display a warning when an ink-containing unit is low in ink or out of ink.

[Patent document 1] Japanese Patent Application Publication No. 2002-370382

A host computer for managing the amounts of remaining color materials in an image forming apparatus is disclosed in patent document 1.The host computer includes a remaining-ink-amount calculation unit for calculating the amount of remaining ink by subtracting the amount of consumed ink in an ink tank of a recording head from the amount of ink initially contained in the ink tank, a remaining-ink-amount information retaining unit for retaining remaining-ink-amount information on the amount of remaining ink for each recording head calculated by the remaining-ink-amount calculation unit, and a remaining-ink-amount information output unit for outputting for users the remaining-ink-amount information retained in the remaining-ink-amount information retaining unit.

[Patent document 2] Japanese Patent Application Publication No. 2005-22146

A remaining-ink-amount detecting apparatus is disclosed in patent document 2. The remaining-ink-amount detecting apparatus is implemented in an inkjet recording apparatus having a carrier for holding ink cartridges and detects the amounts of remaining ink in the ink cartridges in the carrier by using detecting elements on ink cartridges.

[Patent document 3] Japanese Patent Application Publication No. 9-11490

An inkjet recording apparatus is disclosed in patent document 3.The inkjet recording apparatus includes a counting unit for counting the number of dots of print data loaded into a print buffer which can at least contain an amount of print data for one scan, a calculating unit for calculating the amount of ink needed to print the print data (A) based on the counted value, a calculating unit for calculating the amount of ink consumed in print head cleaning (B), a calculating unit for calculating the amount of remaining ink in an ink-tank based on the amounts of ink (A) and (B), a display unit for displaying a message regarding the amount of remaining ink, and a non-volatile memory apparatus for storing the information on the amount of remaining ink.

[Patent document 4] Japanese Patent Application Publication No. 10-175312

A remaining-ink-amount detecting apparatus is disclosed in patent document 4.The remaining-ink-amount detecting apparatus detects the amount of remaining ink based on the liquid level of ink in an ink tank and reports, via a network, remaining-ink-amount information which is represented by the percentage of the amount of remaining ink in proportion to the amount of ink when the ink tank is full.

[Patent document 5] Japanese Patent Application Publication No. 2003-107970

A printer controller is disclosed in patent document 5.The printer controller includes a pixel counting unit for counting the number of pixels actually needed to print an image data on recording paper by using toner or ink, a consumed amount storing unit for storing the cumulative amount of consumed toner/ink which has been used so far to print image data, a processing unit for updating the value of the cumulative amount of consumed toner/ink in the consumed amount storing unit by adding the number of pixels counted by the pixel counting unit and the cumulative amount of consumed toner/ink in the consumed amount storing unit, and a remaining amount detecting unit for calculating the amount of remaining toner/ink based on the cumulative amount of consumed toner/ink in the consumed amount storing unit and the amount of toner/ink initially provided.

As described above, in conventional image forming apparatuses, the amount of remaining color material in a tank or a cartridge is used to report a situation where a tank is low in color material or out of color material, to report the percentage of the amount of remaining color material, or to report the actual amount of remaining color material.

However, with the methods of detecting the amounts of remaining color materials in such conventional image forming apparatuses, a user can know only the timing for replacing a color material tank/cartridge and not know how many pages of a document can be printed with the remaining color materials beforehand.

BRIEF SUMMARY

In accordance with an aspect of this disclosure, an image forming apparatus includes a unit to calculate the number of pages printable with remaining color material based on statistical data on the amount of consumed color material and the number of printed pages and to report the calculated number of pages printable with remaining color material.

The image forming apparatus may preferably include a unit to calculate the amount of remaining color material and report the calculated amount of remaining color material together with the calculated number of pages printable with remaining color material. The calculated number of pages printable with remaining color material may preferably include at least two of the following information items: minimum number of printable pages, average number of printable pages, and maximum number of printable pages. The number of pages printable with remaining color material may preferably be calculated based on the average amount of consumed color material or on the average amount of consumed color material and a deviation from the average amount of consumed color material. Also, the image forming apparatus may preferably include a unit to calculate and report the number of pages printable with remaining color material for each user based on the statistical data for each user.

In accordance wit another aspect of this disclosure, an image forming apparatus is configured to calculate the number of pages printable with remaining color material based on statistical data on the amount of consumed color material and the number of printed pages and to report the calculated number of pages printable with remaining color material. According to still another aspect, an image forming apparatus is provided enabling users to know the number of printable pages before printing and improving convenience for the users.

BRIEF DESCRIPTION OF DRAWINGS

FIGS. 6A and 6B are examples of statistical tables for use by the control unit;

FIGS. 7A and 7B are examples of statistical tables for use by the control unit;

FIGS. 8A and 8B are tables used to describe a method of updating statistical data;

FIGS. 9A and 9B are tables used to describe an example of updating statistical data;

BEST MODE FOR CARRYING OUT THE INVENTION

In the following, an embodiment of the present invention is described in detail with reference to the accompanying drawings.

Figure 1:
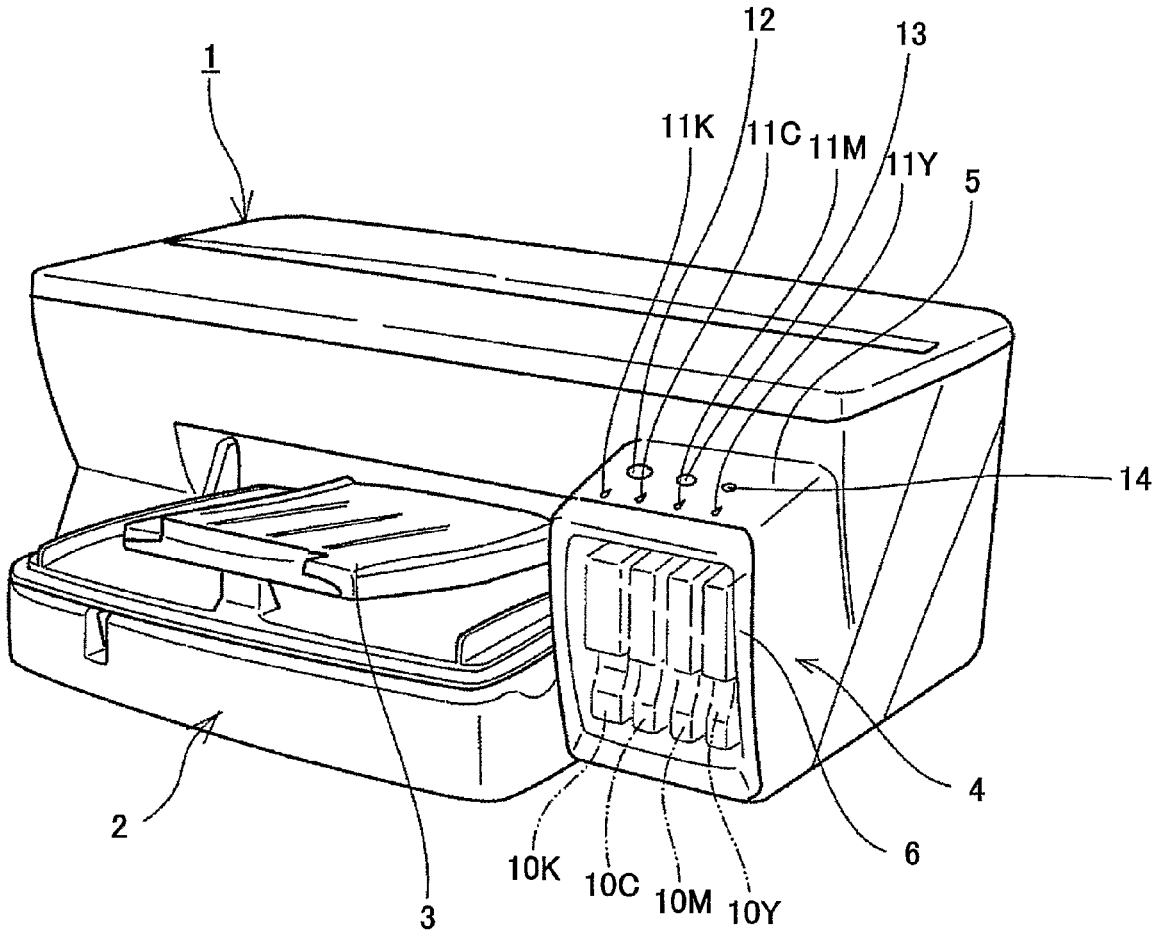
FIG. 1 is a perspective view seen from the front of an inkjet recording apparatus illustrating an example of an image forming apparatus according to the present invention.

FIG. 1 is a perspective view seen from the front of an inkjet recording apparatus which is an example of an image forming apparatus according to the present invention.

The inkjet recording apparatus includes an apparatus body 1, a paper feed tray 2 attached to the apparatus body 1 for storing paper sheets, and a detachable paper catch tray 3 attached to the apparatus body 1 for stacking paper sheets on which images are recorded (formed). The inkjet printing apparatus also includes a cartridge carrier 4 for holding ink cartridges. The cartridge carrier 4 is on the right side of the front face (to the right of the paper feed tray 2 and the paper catch tray 3) and protruding forward from the apparatus body 1. In the illustrated embodiment, the position of the cartridge carrier 4 is below the top face level of the apparatus body 1. An operating/indicating unit 5 on the upper side of the cartridge carrier 4 includes operation buttons and indicators.

The cartridge carrier 4 holds ink cartridges 10*k*, 10*c*, 10*m*, and 10*y* (collectively called ink cartridges 10 for brevity and/or when color distinction is not made) which are examples of containing units which contain different color materials, for example recording liquids or inks. The ink cartridges 10*k*, 10*c*, 10*m*, and 10*y* contain, for example, black (K), cyan (C), magenta (M), and yellow (Y) color material, respectively. In the illustrated exemplary embodiment, the ink cartridges are inserted into the cartridge carrier 4 from the front side of the apparatus body 1 toward its back side. The cartridge carrier 4 has a front cover 6 (a cartridge cover) which can be opened when the ink cartridges 10 are inserted or removed. The ink cartridges 10*k*, 10*c*, 10*m*, and 10*y* are inserted in an upright position and arranged side by side.

The operating/indicating unit 5 includes remaining-amount indicators 11*k*, 11*c*, 11*m*, and 11*y* each indicating that the ink-cartridge 10*k*, 10*c*, 10*m*, or 10*y* is low in ink or out of ink. The positions of the remaining-amount indicators 11*k*, 11*c*, 11*m*, and 11*y* correspond as shown to those of the ink-cartridges 10*k*, 10*c*, 10*m*, and 10*y*. The operating/indicating unit 5 further includes a power button 12, a paper feed/print-resume button 13, and a cancel button 14.

Figure 2:
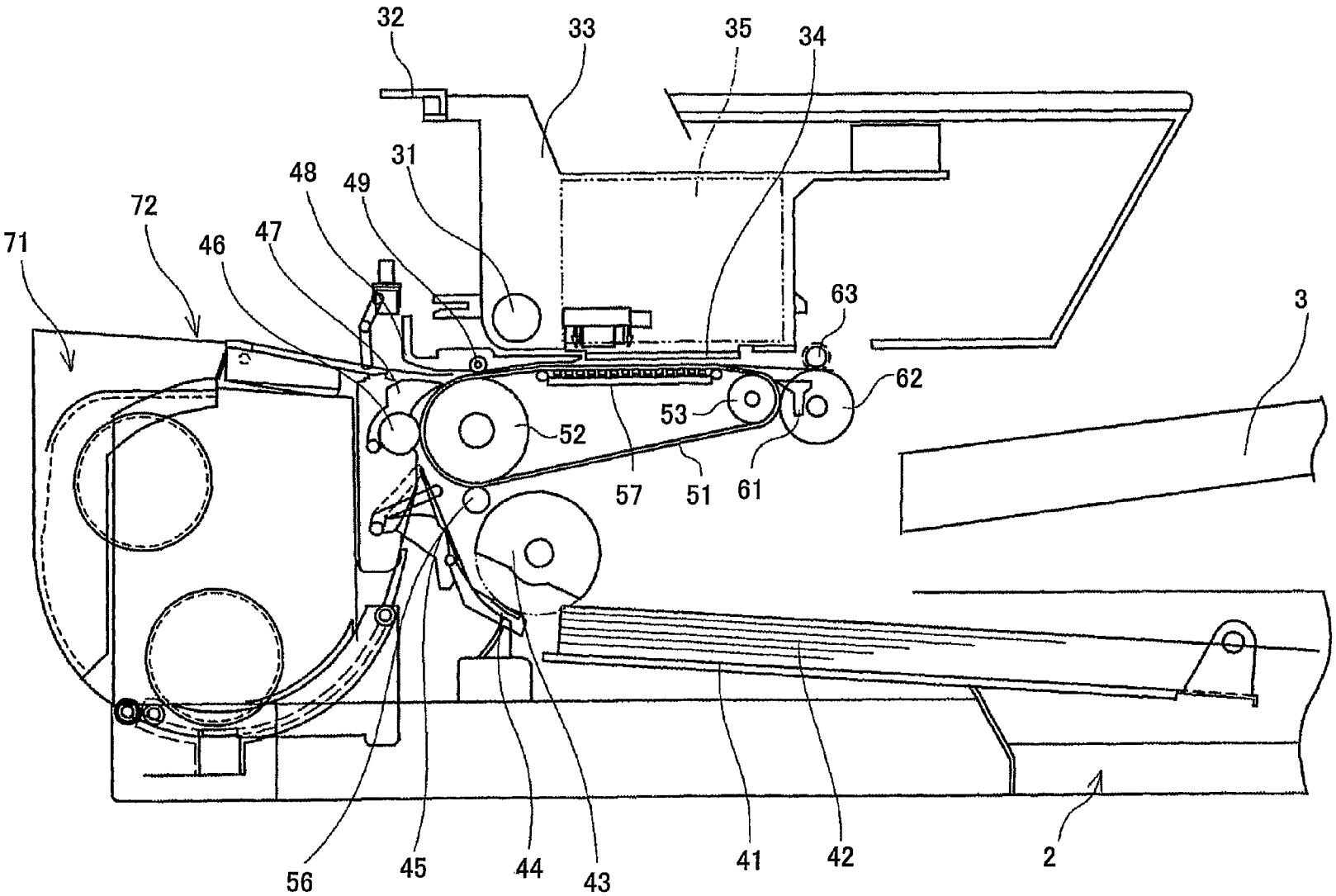
FIG. 2 is a schematic elevational view illustrating an exemplary configuration of a mechanical unit of the inkjet recording apparatus.
Figure 3:
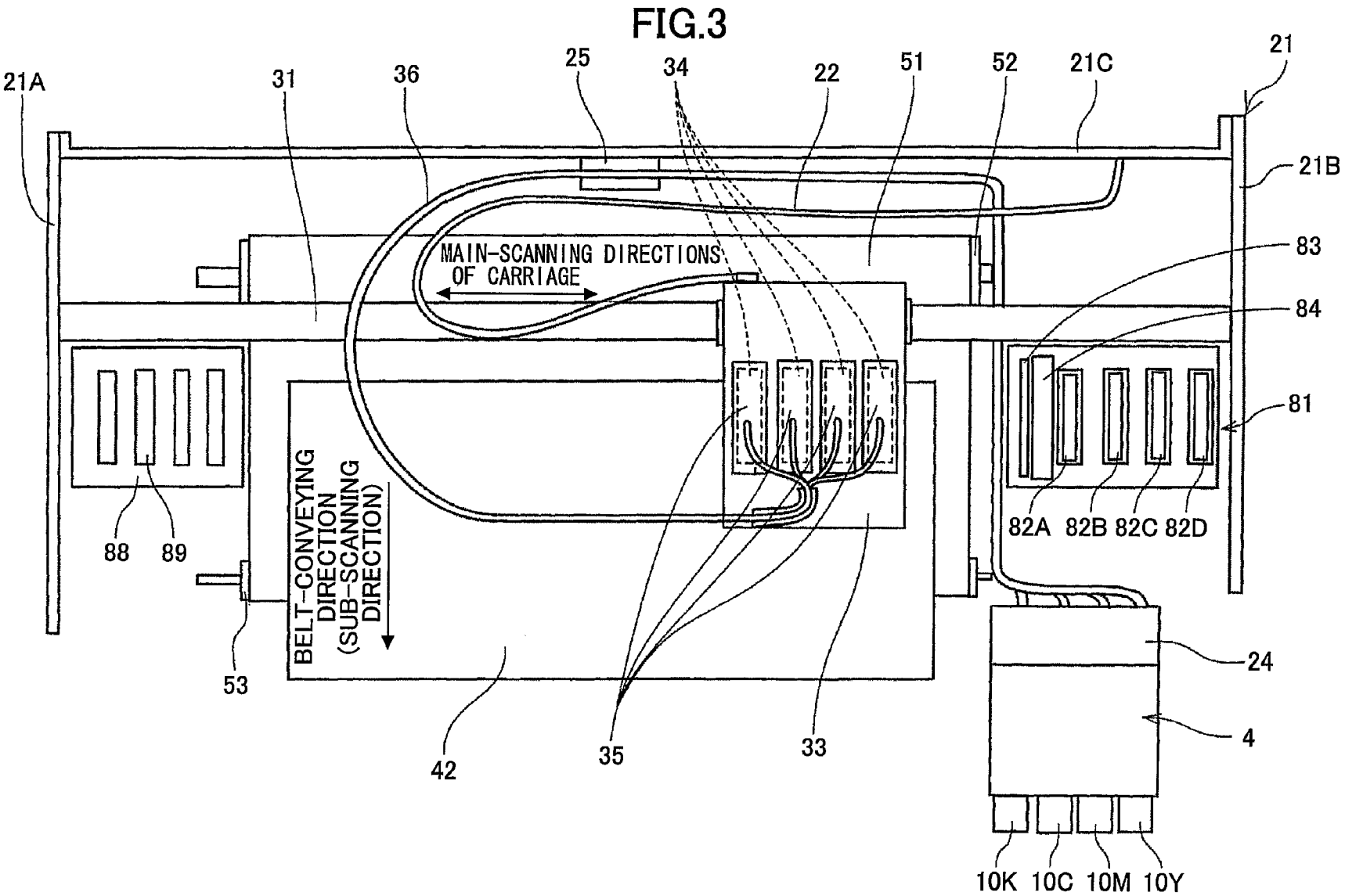
FIG. 3 is a plan view illustrating a portion of the mechanical unit.

Next, a mechanical unit of the inkjet recording apparatus is described with reference to FIGS. 2 and 3. FIG. 2 is a schematic elevational view illustrating an exemplary of the mechanical unit. FIG. 3 is a plan view illustrating hereindescribed parts of the mechanical unit.

A carriage 33 is supported by guiding parts including a guide rod 31 and a stay 32 so as to be able to slide in main-scanning directions. The guiding parts are laid between side-boards 21A and 21B on the left and right sides of a frame 21. The carriage 33 is movable for scanning by a main-scanning motor (not shown) through a timing belt in the directions of the arrows (main-scanning directions).

The carriage 33 includes four liquid drop spraying recording heads 34 for spraying yellow (Y), cyan (C), magenta (M), and black (K) ink drops. The liquid drop spraying heads include respective ink spray nozzles. The liquid drop spraying heads are positioned so that their ink spray nozzles form a line that intersects with the main-scanning directions and the ink spray nozzles face downward.

Each of the liquid drop spraying heads comprising the recording heads 34 includes a pressure-generating unit for generating pressure used to spray liquid drops. For such a pressure-generating unit, a piezoelectric actuator such as a piezoelectric element, a thermal actuator using phase changes resulting from liquid film boiling caused by an electrothermal converting element such as a heat element, a shape memory alloy actuator using metal phase changes caused by temperature changes, or an electrostatic actuator using static electricity may be used.

The recording heads 34 include a driver IC connected via a harness 22 (a flexible print cable) to a control unit (not shown).

The carriage 33 also includes a sub-tank 35 for each color to supply each color ink to each recording head 34. Each color ink is supplied to its corresponding sub-tank 35 from its respective ink cartridge 10 in the cartridge carrier 4 through an ink supply tube 36 for each color. The cartridge carrier 4 includes a supply pump unit 24 for carrying ink from the ink cartridges 10. The ink supply tubes 36 are preferably fixed as shown by a holding part 25 on a backboard 21C of the frame 21.

The mechanical unit also includes a paper feeding unit for feeding paper sheets 42 stacked on a paper stacking plate (a pressing plate) 41 in the paper feed tray 2. The paper feeding unit includes a crescent roller (a paper feed roller) 43 for separating the paper sheets 42 and feeding them one by one, and a separating pad 44 which is facing the crescent roller 43 and made of a material with a high friction coefficient. The separating pad 44 is biased toward the crescent roller 43.

The mechanical unit also includes a guide 45 for guiding a paper sheet 42 fed from the paper feeding unit to a position under the recording heads 34, a counter roller 46, a conveying guide 47, a pressing part 48 having a paper-edge pressing roller 49, and a conveying belt 51 that conveys and electrostatically attracts the paper sheet 42 so that the sheet faces the recording heads 34.

The conveying belt 51 is an endless belt stretched between a conveying roller 52 and a tension roller 53 and is configured to turn in the belt conveying direction (sub-scanning direction). A charging roller 56 charges the surface of the conveying belt 51 and is positioned so as to contact the surface of the conveying belt 51 and rotate according to the rotation of the conveying belt 51. A guide 57 is positioned under the conveying belt 51 so as to cover the printing area of the recording heads 34.

The conveying belt 51 is turned in the belt conveying direction shown in FIG. 3 by the conveying roller 52 which is rotated by a sub-scanning motor (not shown) through a timing belt.

The mechanical unit further includes a paper ejecting unit for ejecting the paper sheet 42 on which images are recorded by the recording heads 34. The paper ejecting unit includes a sheet separating claw 61 for separating the paper sheet 42 from the conveying belt 51, a paper ejecting roller 62, and a paper ejecting roller 63. In the as-shown embodiment, the paper catch tray 3 is positioned under the paper ejecting roller 62.

A detachable duplex unit 71 is attached to the back side of the apparatus body 1. The duplex unit 71 takes in the paper sheet 42 which is conveyed backward by the conveying belt 51 turning in the opposite direction, reverses the paper sheet 42, and feeds the sheet again into the space between the counter roller 46 and the conveying belt 51. The upper face of the duplex unit 71 is used as a manual paper feed tray 72.

Also, as shown in the exemplary embodiment of FIG. 3, a print head maintenance/cleaning mechanism 81 is positioned for example to the right of the carriage 33, in a non-printing area. The print head maintenance/cleaning mechanism 81 maintains and cleans the nozzles of the recording heads 34.

The print head maintenance/cleaning mechanism 81 includes caps 82*a*, 82*b*, 82*c*, and 82*d* (collectively called caps 82 for brevity and/or when distinction is not made) for covering the nozzle surfaces of the recording heads 34, a wiper blade 83 for wiping the nozzle surfaces, and a waste-ink receiver 84 for receiving ink drops used for purging dried ink from the nozzles. The cap 82*a* is used for suction and moisture retention and the caps 82*b*, 82*c*, and 82*d* are used for moisture retention.

The ink used in the maintenance/cleaning process by the print head maintenance/cleaning mechanism 81, the ink ejected to the caps 82, the ink removed from the wiper blade 83 by the wiper cleaner 85, and the ink ejected to the waste-ink receiver 84 are discharged into and contained in a waste ink tank (not shown).

Further, as shown in the exemplary embodiment of FIG. 3, a waste-ink receiver 88 for receiving ink drops used for purging dried ink from the nozzles during recording is positioned for example to the left of the carriage 33, in the non-printing area. The waste-ink receiver 88 has openings 89 along the length of a nozzle array of the recording heads 34.

In the inkjet recording apparatus configured as described above, paper sheets 42 are fed one by one from the paper feed tray 2, the separated paper sheet 42 is fed approximately vertically upward and guided by the guide 45 into the space between the conveying belt 51 and the counter roller 46 so as to be conveyed further, the front edge of the paper sheet 42 is guided by the conveying guide 47 and pressed by the paper-edge pressing roller 49 onto the conveying belt 51, and then the direction wherein the paper sheet 42 is conveyed is changed approximately 90 degrees.

At this stage, an AC bias supply unit in a control unit described below applies alternating voltages to the charging roller 56 by alternately outputting plus and minus voltages. As a result, positively and negatively charged strips with a constant width are formed alternately along the turning (or the sub-scanning) direction on the surface of the conveying belt 51. When the paper sheet 42 is conveyed onto the conveying belt 51 with positively and negatively charged strips, the paper sheet 42 is attracted to the conveying belt 51 and is conveyed in the sub-scanning direction as the conveying belt 51 turns.

Then, the recording heads 34 are driven and the carriage 33 is moved according to image signals to spray ink drops and record a line of image on the paused paper sheet 42. The paper sheet 42 is conveyed a specified distance, and the next line is recorded. When a recording completion signal or a signal indicating that the rear edge of the paper sheet 42 reaches the printing area is received, the inkjet recording apparatus terminates the printing and ejects the paper sheet 42 into the paper catch tray 3.

When the inkjet recording apparatus is idle, the carriage 33 is moved into a position above the print head maintenance/cleaning mechanism 81. In the position, the recording heads 34 are covered by the caps 82 to retain moisture of the nozzles and to prevent nozzle clogging caused by dried ink. With the recording heads 34 capped, the nozzles are suctioned (called nozzle suction or head suction) by a suction pump (not shown) to remove dried ink or air bubbles. Also, before or during printing, ink is sprayed in order to clean the nozzles. With the above measures, the spray performance of the recording heads 34 is maintained.

Figure 4:
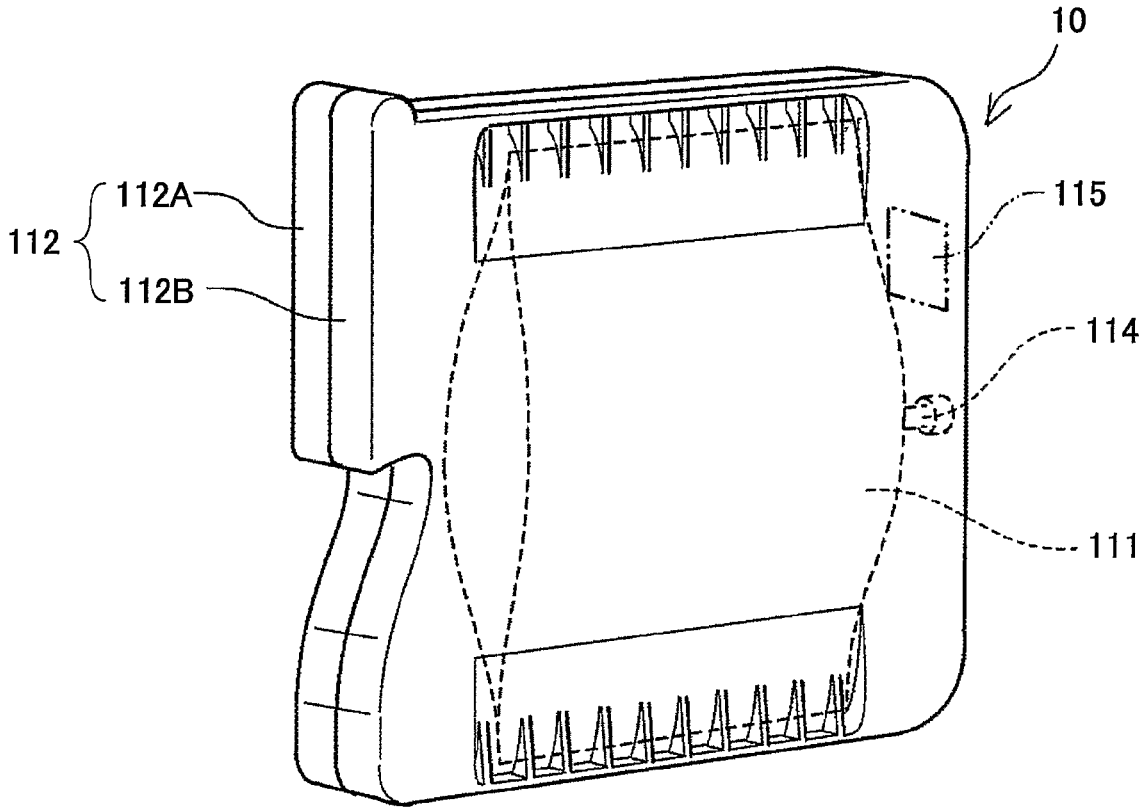
FIG. 4 is a perspective view illustrating an example of an ink cartridge for the inkjet recording apparatus.

Next, an example of an ink cartridge 10 is described with reference to FIG. 4. The ink cartridge 10 includes an ink bag 111 filled with ink and a case 112 for housing the ink bag 111. The ink bag 111 is removable. The case 112 includes and is separable into a case number 1 112A and a case number 2 112B, which protect the ink bag 111. In other words, the case 112 has two parts, the case number 1 112A and the case number 2 112B, having faces parallel to the ink supply direction (ink ejecting direction) for housing the ink bag 111.

The ink bag 111 includes an ink outlet 114 connectable to a supply needle in the back of the cartridge carrier 4 when the ink cartridge 10 is inserted into the cartridge carrier 4 of the apparatus body 1.

The ink cartridge 10 includes a non-volatile memory (an EEPROM, for example) 115 positioned for example on the face of the case 112 where the ink outlet 114 is positioned (the back face). The non-volatile memory 115 stores information pertaining to the ink cartridge 10, including ink color, ink type, expiration date, and ID number. The non-volatile memory 115 is electrically connected, when the ink cartridge 10 is inserted into the cartridge carrier 4, to an electrode of the apparatus body 1, which is positioned in the back of the cartridge carrier 4. The information stored in the non-volatile memory 115 is loaded into the control unit of the apparatus body 1.

Figure 5:
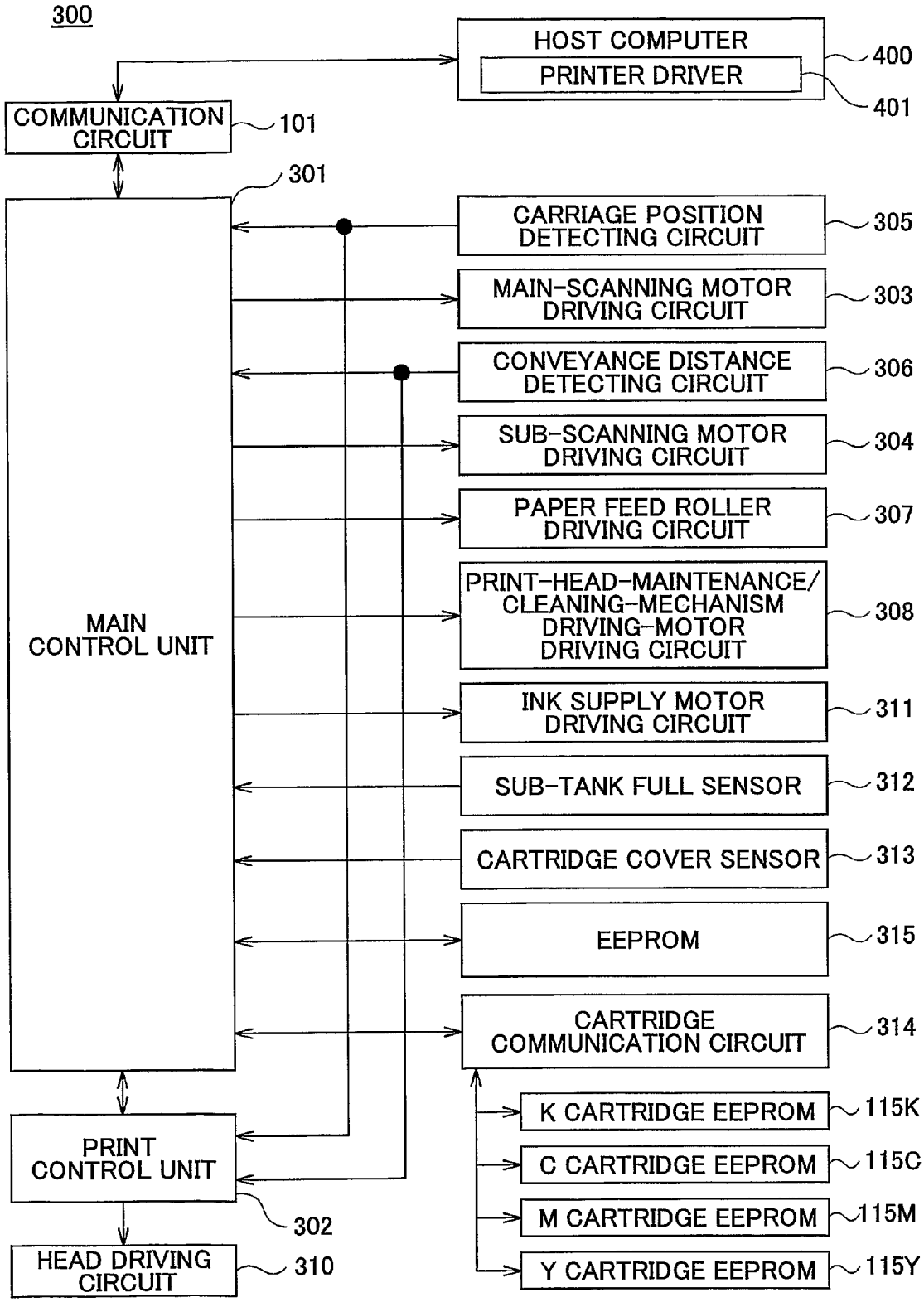
FIG. 5 is a block diagram outlining a control unit for controlling the inkjet recording apparatus.

The control unit of this image forming apparatus is outlined with reference to FIG. 5. FIG. 5 is a block diagram outlining the control unit.

The control unit 300 includes a main control unit 301 and a print control unit 302. The main control unit 301 includes a microprocessor for controlling the overall operation of the image forming apparatus, including the control related to the number of printable pages according to an embodiment of the present invention. The print control unit 302 includes a microcomputer for controlling printing.

More specifically, the main control unit 301 controls a main-scanning motor (not shown) and a sub-scanning motor (not shown) through a main-scanning motor driving circuit 303 and a sub-scanning motor driving circuit 304 to form images on the paper sheets 42 according to information including print data sent via a communication circuit 101 from a host computer 400 including a printer driver 401. The host computer 400 may be a personal computer, for example. The main control unit 301 also transmits the print data to the print control unit 302.

The main control unit 301 receives a detection signal from a carriage position detecting circuit 305 for detecting a position of the carriage 33 and controls the next position and the movement speed of the carriage 33 based on the received signal. The carriage position detecting circuit 305 detects a position of the carriage 33, for example, by reading and counting the number of slits on an encoder sheet arranged in the scanning directions of the carriage 33 using a photo sensor in the carriage 33. The main-scanning motor driving circuit 303 rotates the main-scanning motor according to carriage movement distance signal received from the main control unit 301 to move the carriage 33 to a specified position at a specified speed.

The main control unit 301 receives a detection signal from a conveyance distance detecting circuit 306 for detecting a conveyance distance of the conveying belt 51, and controls the conveyance distance and the movement speed of the conveying belt 51 based on the detection signal. The conveyance distance detecting circuit 306 detects the conveyance distance, for example, by reading and counting the number of slits on a rotation encoder sheet on the rotating shaft of the conveying roller 52 using a photo sensor. The sub-scanning motor driving circuit 304 rotates the sub-scanning motor according to a conveyance distance received from the main control unit 301 to rotate the conveying roller 52 so as to move the conveying belt 51 for a specified distance at a specified speed.

The main control unit 301 rotates the paper feed roller 43 once by sending a paper feed roller driving instruction to a paper feed roller driving circuit 307. The main control unit 301 moves the caps 82 and the wiper blade 83 up/down by rotating a motor (not shown) through a print-head-maintenance/cleaning-mechanism driving-motor driving circuit 308.

The main control unit 301 controls through an ink supply motor driving circuit 311 an ink supply motor (not shown) for driving the supply pump unit 24 to supply ink to the sub-tanks 35 from the ink cartridges 10 in the cartridge carrier 4.

The main control unit 301 also receives a detection signal from a sub-tank full sensor 312 indicating that the sub-tank 35 is full and a detection signal from a cartridge cover sensor 312 indicating the open/close status of the front cover 6 of the cartridge carrier 4.

The main control unit 301, through a cartridge communication circuit 314, reads information from non-volatile memories 115*k*, 115*c*, 115*m*, 115*y* (collectively called non-volatile memories 115 for brevity and/or when no distinction is made) on the ink cartridges 10 in the cartridge carrier 4, performs processing, and then stores the information in a non-volatile memory (an EEPROM, for example) 315 of the main control unit 301.

To detect the remaining ink amount of an ink cartridge 10, after each printing or each time when ink is supplied from the ink cartridge 10 to the sub-tank 35, the main control unit 301 reads old remaining-ink-amount information currently stored in the non-volatile memory 115 on the ink cartridge 10, temporarily stores the information in the non-volatile memory 315 of the main control unit 301, calculates consumed ink amount based on a value obtained by counting the number of ink drops sprayed from the recording head 34, and writes new remaining-ink-amount information obtained based on the old remaining ink amount and the consumed ink amount into the non-volatile memory 115 of the ink cartridge 10. The main control unit 301 determines that an ink cartridge 10 is low in ink or out of ink by reading the remaining-ink-amount information stored in the non-volatile memory 115 on the ink cartridge 10.

The print control unit 302 generates data for driving a pressure-generating unit. Each recording head 34 includes a pressure-generating unit and uses it to spray ink drops. The print control unit 302 generates data based on signals from the main control unit 301, a carriage position signal from the carriage position detecting circuit 305, and a conveyance distance signal from the conveyance distance detecting circuit 306. The print control unit 302 passes the data to a head driving circuit 310.

The head driving circuit 310 drives the pressure-generating units (piezoelectric elements, for example) of the recording heads 34 according to the print data generated by the print control unit 302 to spray ink drops from the corresponding ink spray nozzles.

Further, the main control unit 301 stores statistical information (data) on the amount of consumed ink and the number of printed pages in the non-volatile memory 315. When information on the number of printable pages is requested by the printer driver 401 in the host computer 400, the main control unit 301 calculates the number of pages printable with remaining color materials based on statistical data on the amounts of consumed color materials and the number of printed pages, and reports the calculated number of pages printable with remaining color materials together with the remaining-ink-amount information to the host computer 400. When the above information is received from the image forming apparatus, the printer driver 401 displays, for example, the number of printable pages on a printer property dialog box of the host computer 400.

In the following, exemplary processes in relation to the amount of remaining ink and the number of printable pages are described in detail with reference to FIGS. 6A, 6B, and later.

In the image forming apparatus, statistical information (data) on the amount of remaining color material and the number of printed pages is stored for each color in each table (hereafter called a statistical table) in the non-volatile memory 315 of the main control unit 301.

Specific examples of the statistical tables are described below with reference to FIGS. 6A, 6B, 7A, and 7B. FIG. 6A is a statistical table for black; FIG. 6B is for cyan; FIG. 7A is for magenta; and FIG. 7B is for yellow.

Each statistical table contains information items including, for each user, a user identifier, the number of printed pages (accumulated number of printed pages), the amount of consumed color material per page (A), the amount of consumed color material squared and divided by the number of printed pages (B), and remaining color material amount (F). The number of printable pages is calculated based on the number of printed pages and the amount of consumed color material in the table.

More specifically, a standard deviation of the amount of consumed color material per page (C) is calculated by the following formula (1) based on the aforementioned values (A) and (B). In the formula, "*" denotes multiplication.

$$C=\mathrm{SQRT}\,(B-A*A) \tag{1}$$

A minimum amount of consumed color material per page (D) within the range of the standard deviation is calculated by the following formula (2):

$$D=A-C \quad (2)$$

A maximum amount of consumed color material per page (E) within the range of the standard deviation is calculated by the following formula (3):

$$E=A+C \quad (3)$$

An average number of pages (G), a maximum number of pages (H), and a minimum number of pages (I), which are printable with the remaining color material amount (F), are calculated by the following formulas (4), (5), and (6):

$$G=F/A \quad (4)$$

$$H=F/D \quad (5)$$

$$I=F/E \quad (6)$$

An average number of pages (G), a maximum number of pages (H), and a minimum number of pages (I) are calculated for each color material. Among the calculated values, the smallest values for (G), (H), and (I) are reported to the host computer 400 as the average, maximum, and minimum numbers of printable pages.

In the examples shown in FIGS. 6A, 6B, 7A, and 7B, for each user having a user identifier "hanako" or "taro", the number of printed pages, the amount of consumed color material per page (A), and the amount of consumed color material squared and divided by the number of printed pages (B) are stored. For "Total", the total number of printed pages, the amount of consumed color material per page (A), and the amount of consumed color material squared and divided by the total number of printed pages (B) are stored.

As described above, by storing statistical data for each user and reporting the number of pages printable with remaining color materials to each user, the image forming apparatus according to an embodiment of the present invention enables each user to know more accurately the number of printable pages (the range and average number of pages) that matches his/her way of using the image forming apparatus.

Next, a method of updating statistical data is described with reference to FIGS. 8A and 8B.

In FIG. 8A, the number of newly printed pages is represented by N and the amount of consumed color material is represented by P. In the row for the old (current) values of the statistical table shown in FIG. 8B, the number of printed pages is represented by M, the amount of consumed color material per page (A) is represented by Am, and the amount of consumed color material squared and divided by the number of printed pages (B) is represented by Bm. In the row for the new values, the number of printed pages is calculated by a formula "M+N", (A) is calculated by a formula "(M*Am+P)/(M+N)", and (B) is calculated by a formula "(M*Bm+P+P/N)/(M+N)". The resulting values are stored as current values.

FIGS. 9A and 9B are tables used to describe an example of updating statistical data. FIG. 9A is an example for a user "taro" in which the number of newly printed pages is 8 and the amount of consumed material is 45. In FIG. 9B, statistical data is updated based on the values in FIG. 9A.

Next, a process performed for example by the control unit for calculating and reporting the amounts of remaining color materials and the number of printable pages is described with reference to FIG. 10.

Figure 10:
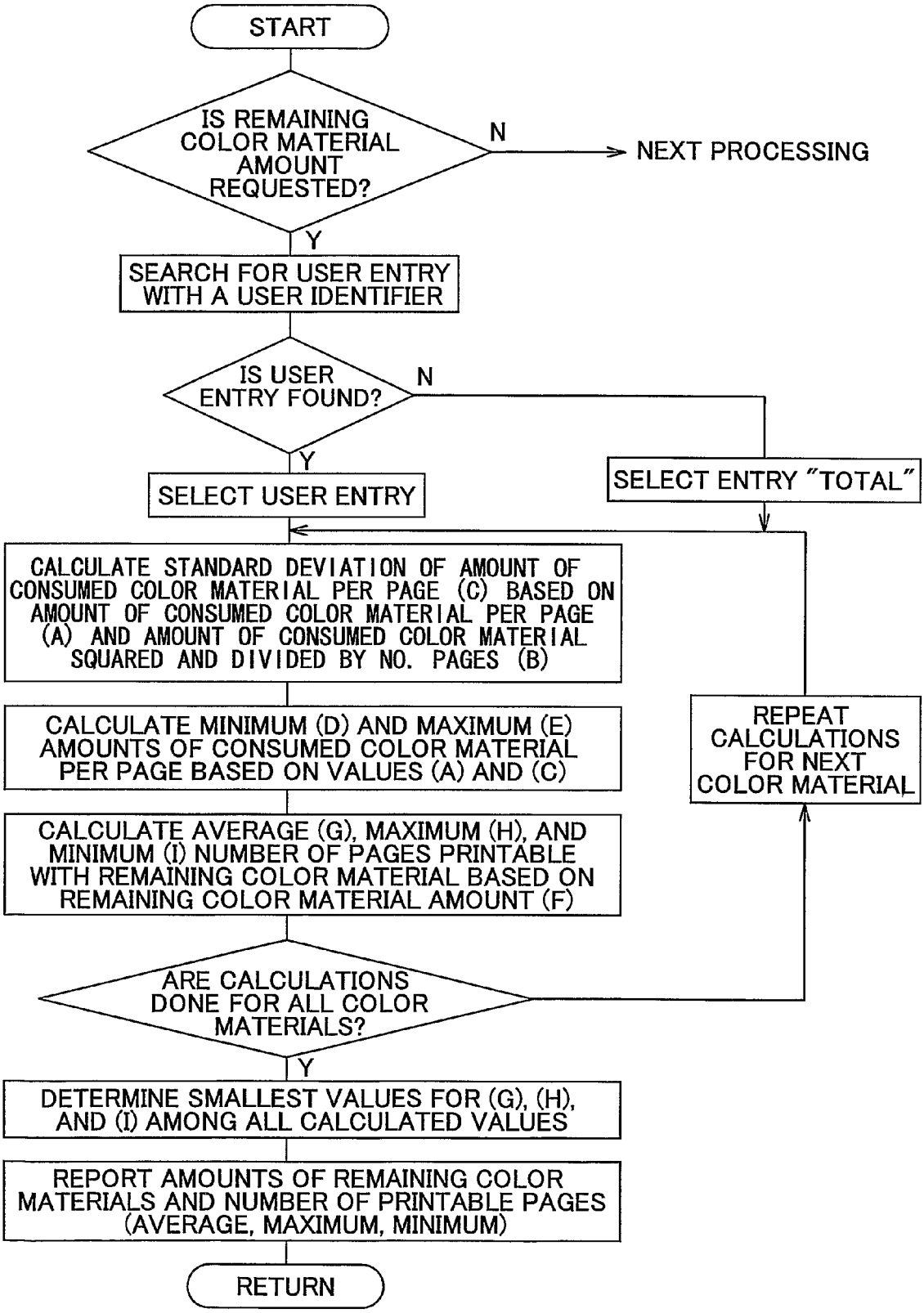
FIG. 10 is a flowchart describing a process of calculating and reporting amounts of remaining color materials and number of printable pages.

Referring to FIG. 10, when information on the amounts of remaining color materials is requested for example from the printer driver 401 in the host computer 400, the control unit determines whether the user corresponding to a user identifier in the request has an entry in the statistical table for each color material. When the user has an entry in the statistical table, the control unit selects the entry of the user for updating. When the user has no entry in the statistical table, the control unit selects the entry of "Total" for updating.

The control unit calculates the standard deviation of the amount of consumed color material per page (C) based on the amount of consumed color material per page (A) and the amount of consumed color material squared and divided by the number of printed pages (B). Then, the control unit calculates the minimum amount of consumed color material per page (D) and the maximum amount of consumed color material per page (E) based on values (A) and (C). Further, the control unit calculates, based on the remaining color material amount (F), the average number of pages (G), the maximum number of pages (H), and the minimum number of pages (I) which are printable with the remaining color material.

In an exemplary embodiment, the control unit determines whether the above calculations have been performed for all color materials. If the calculations have not been performed for all color materials, the control unit performs the calculations for the next color material, and so on. After completing calculations for all color materials, the control unit determines the smallest values for (G), (H), and (I) among all the calculated (G), (H), and (I) values, and uses those values as the average, maximum, and minimum numbers of printable pages.

The control unit reports the amounts of remaining color materials and the average, maximum, and minimum numbers of printable pages to the printer driver 401 in the host computer 400. The printer driver 401 displays the amounts of remaining color materials and the average, maximum, and minimum numbers of printable pages, for example, on a printer property dialog box.

As described above, an image forming apparatus according to an embodiment of the present invention is configured to calculate the number of pages printable with remaining color materials based on statistical data on the amounts of consumed color materials and the number of printed pages and to report the calculated number of pages printable with remaining color materials, thereby enabling users to know the number of printable pages before printing and improving convenience for the users.

According to another aspect of the invention, the image forming apparatus may include a unit to report remaining amount information on the amounts of remaining color materials together with the number of pages printable with remaining color materials, thereby further improving convenience for users. Also, the number of pages printable with remaining color materials may include at least two of the following information items: minimum number of printable pages, average number of printable pages, and maximum number of printable pages, thereby enabling users to know more detailed information on the number of printable pages.

In the image forming apparatus, the number of printable pages can be easily obtained by calculating based on the average amounts of consumed color materials. Also, or alternatively, a more accurate number of printable pages can be obtained by calculating based on the average amounts of consumed color materials and the deviations from the average amounts of consumed color materials. Although the amounts of consumed color materials per page on a printer may vary depending on user document data or print settings, this variation is minimized in a general office environment where printers are used almost uniformly. Also, each user's consumption of color materials per page is generally constant. Therefore, reasonably accurate number of printable pages can be obtained by calculating based on the average amounts of consumed materials.

A process for updating statistical data during printing according to an embodiment of the invention is described below with reference to FIG. 11.

Figure 11:
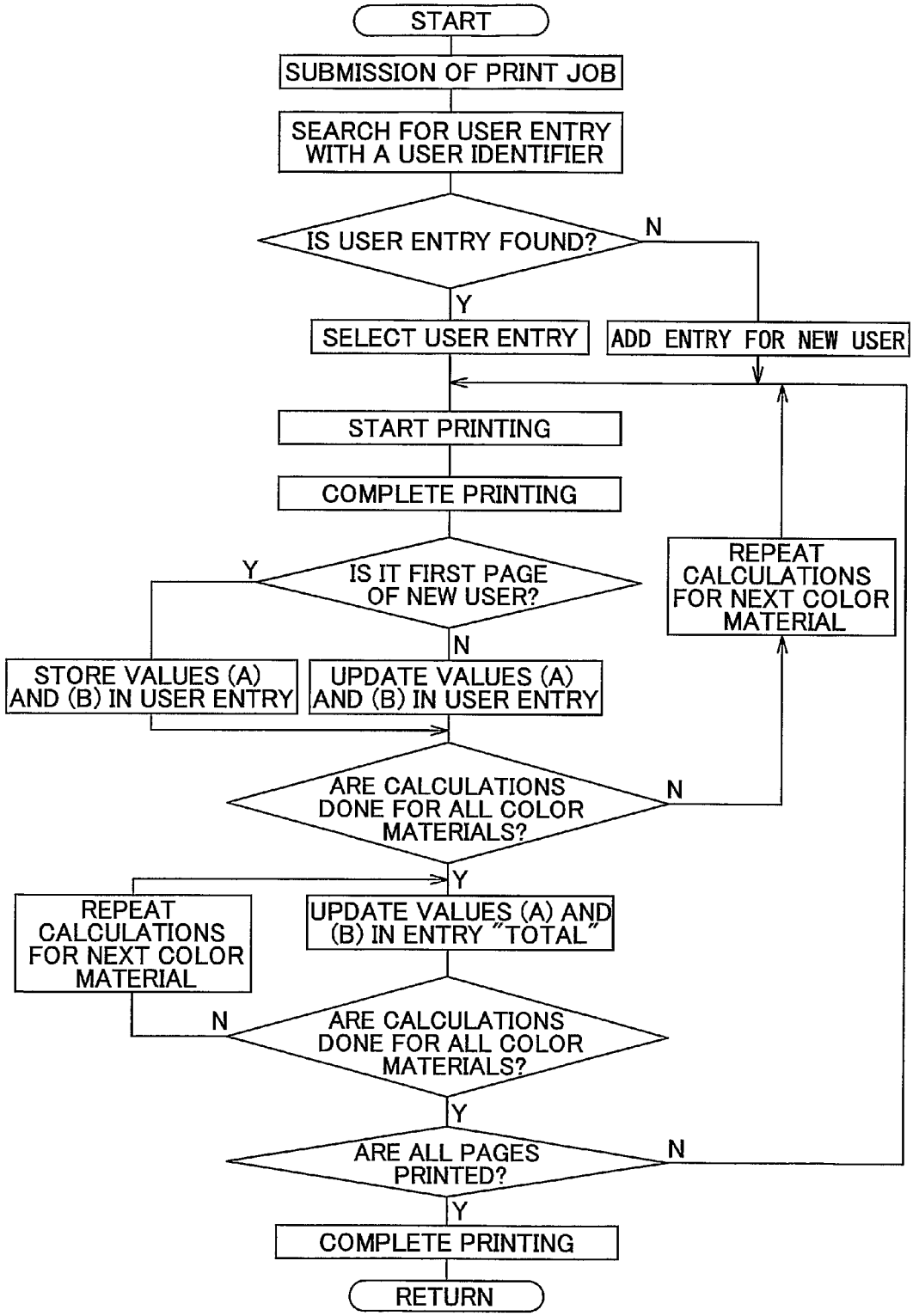
FIG. 11 is a flowchart describing a process of updating the statistical data.

Referring to FIG. 11, when a print job is submitted, the control unit determines whether the user corresponding to a user identifier in the print job has an entry in the statistical table for each color. When the user has an entry in the statistical table, the control unit selects the entry of the user for updating. When the user has no entry in the statistical table, the control unit adds an entry of the new user to the table.

The control unit starts printing a page. When printing the page is completed, the control unit determines whether the printed page is the first page of a new user. When the printed page is the first page of a new user, the control unit calculates the amount of consumed color material per page (A) and the amount of consumed color material squared and divided by the number of printed pages (B) based on the amount of color material used for printing the first page, and stores the calculated values in the user's entry. The control unit calculates the values (A) and (B) for each color material. When the printed page is a page of an existing user, the control unit calculates the values (A) and (B) for each color material and updates values for the color materials.

Then, the control unit updates values (A) and (B) in the entry of "Total" for each color material.

The control unit repeats the above steps of starting printing a page and later as shown in the flowchart of FIG. 11 until all pages of the print job are printed. When all pages are printed, the process of updating statistical data during printing is terminated.

The control unit thus updates the statistical data on the amounts of consumed color materials during printing. When information on the amounts of remaining color materials is requested for example from the host computer 400, the control unit calculates and reports the amounts of remaining color materials and the number of printable pages.

Although black, cyan, yellow, and magenta inks are used in the above described embodiments for descriptive purpose, other color inks such as dark cyan, dark magenta, light cyan, light magenta, red, blue, and green may also be used. Also, it will be appreciated that the afore described embodiments can be applied to an image forming apparatus using color materials other than ink, such as toner for example. Further, afore described embodiments can be applied to an image forming apparatus using only one color material.

The present invention is not limited to the specifically disclosed embodiments, and variations and modifications may be made without departing from the scope of the present invention.

The present application is based on Japanese Priority Application No. 2005-165965, filed on Jun. 6, 2005, the entire contents of which are hereby incorporated herein by reference.

The invention claimed is:

1. An image forming apparatus which forms images by using a color material, comprising:

a statistical table including user statistical data on amount of consumed color material and a number of printed pages for each user, and total statistical data on total amount of consumed color material and a total number of printed pages; and a control unit configured to receive a request including a user identifier of a user from a host computer, determine whether the user statistical data corresponding to the user identifier is present in the statistical table, calculate a number of pages printable with remaining color material based on user statistical data if the user statistical data corresponding to the user identifier is present in the statistical table, or based on the total statistical data if the user statistical data corresponding to the user identifier is not present in the statistical table, and report the calculated number of pages printable with the remaining color material.

2. The image forming apparatus as claimed in claim 1, further comprising:

a unit configured to calculate amount of the remaining color material and report the calculated amount of the remaining color material together with the calculated number of pages printable with the remaining color material.

3. The image forming apparatus as claimed in claim 1, wherein the calculated number of pages printable with the remaining color material includes at least two of the following information items: a minimum number of printable pages, an average number of printable pages, and a maximum number of printable pages.

4. The image forming apparatus as claimed in claim 1, wherein the number of pages printable with the remaining color material is calculated based on average amount of consumed color material.

5. The image forming apparatus as claimed in claim 1, wherein the number of pages printable with the remaining color material is calculated based on average amount of consumed color material and a deviation from the average amount of consumed color material.

6. An image forming method which forms images by using a color material, comprising the steps of:

maintainig a statistical table including user statistical data on amount of consumed color material and a number of printed pages for each user, and total statistical data on total amount of consumed color material and a total number of printed pages;

receiving a request including a user identifier of a user from a host computer;

determining whether the user statistical data corresponding to the user identifier is present in the statistical table;

calculating a number of pages printable with remaining color material based on user statistical data if the user statistical data corresponding to the user identifier is present in the statistical table, or based on the total statistical data if the user statistical data corresponding to the user identifier is not present in the statistical table; and reporting the calculated number of pages printable with the remaining color material.

7. The image forming method as claimed in claim 6, further comprising the step of:

calculating amount of the remaining color material and reporting the calculated amount of the remaining color material together with the calculated number of pages printable with the remaining color material.

8. The image forming method as claimed in claim 6, wherein the calculated number of pages printable with the remaining color material includes at least two of the following information items: a minimum number of printable pages, an average number of printable pages, and a maximum number of printable pages.

9. The image forming method as claimed in claim 6, wherein the number or pages printable with the remaining color material is calculated based on average amount of consumed color material.

10. The image forming method as claimed in claim 6, wherein the number of pages printable with the remaining color material is calculated based on average amount of consumed color material and a deviation from the average amount of consumed color material.

11. An image forming apparatus which forms images by using a color material, comprising:

a statistical table including user statistical data on amount of consumed color material and a number of printed pages for each user, and total statistical data on total amount of consumed color material and a total number of printed pages; and control means for receiving a request including a user identifier of a user from a host computer, determine whether the user statistical data corresponding to the user identifier is present in the statistical table, calculating a number of pages printable with remaining color material based on user statistical data if the user statistical data corresponding to the user identifier is present in the statistical table, or based on the total statistical data if the user statistical data corresponding to the user identifier is not present in the statistical table, and reporting the calculated number of pages printable with the remaining color material.

12. The image forming apparatus as claimed in claim 11, further comprising:

means for calculating amount of the remaining color material and reporting the calculated amount of the remaining color material together with the calculated number of pages printable with the remaining color material.

13. The image forming apparatus as claimed in claim 11, wherein the calculated number of pages printable with the remaining color material includes at least two of the following information items: a minimum number of printable pages, an average number of printable pages, and a maximum number of printable pages.

14. The image forming apparatus as claimed in claimed 11, wherein the number of pages printable with the remaining color material is calculated based on average amount of consumed color material.

15. The image forming apparatus as claimed in claim 11, wherein the number of pages printable with the remaining color material is calculated based on average amount of consumed color material and a deviation from the average amount of consumed color material.

* * * * *

UNITED STATES PATENT AND TRADEMARK OFFICE

CERTIFICATE OF CORRECTION

PATENT NO. : 7,618,115 B2
APPLICATION NO. : 11/630521
DATED : November 17, 2009
INVENTOR(S) : Yoshinari Chigusa It is certified that error appears in the above-identified patent and that said Letters Patent is hereby corrected as shown below:

Replace the PCT Application No. on the Title page of the patent, with the following:

Item -- (86) PCT No.: PCT/JP2006/310596 --

Signed and Sealed this

Seventeenth Day of August, 2010

David J. Kappos

David J. Kappos
*Director of the United States Patent and Trademark Office*